US009222638B2

(12) United States Patent
Nakada et al.

(10) Patent No.: US 9,222,638 B2
(45) Date of Patent: Dec. 29, 2015

(54) VEHICULAR HEADLAMP

(71) Applicant: KOITO MANUFACTURING CO., LTD., Tokyo (JP)

(72) Inventors: Yusuke Nakada, Shizuoka (JP); Yuta Ugajin, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 182 days.

(21) Appl. No.: 13/917,848

(22) Filed: Jun. 14, 2013

(65) Prior Publication Data

US 2013/0343076 A1 Dec. 26, 2013

(30) Foreign Application Priority Data

Jun. 26, 2012 (JP) ..... 2012-143334
Mar. 22, 2013 (JP) ..... 2013-060960

(51) Int. Cl.
*F21S 8/10* (2006.01)

(52) U.S. Cl.
CPC ..... *F21S 48/1317* (2013.01); *F21S 48/1159* (2013.01); *F21S 48/1388* (2013.01); *F21S 48/145* (2013.01)

(58) Field of Classification Search
CPC ..... F21S 48/1159; F21S 48/14; F21S 48/145; F21S 48/1763–48/1789
See application file for complete search history.

(56) References Cited

U.S. PATENT DOCUMENTS

2008/0239740 A1* 10/2008 Nakada et al. ..... 362/507
2008/0239745 A1* 10/2008 Naganawa et al. ..... 362/516
2010/0177525 A1* 7/2010 Iwasaki ..... 362/517

FOREIGN PATENT DOCUMENTS

JP 2008243433 10/2008

* cited by examiner

*Primary Examiner* — Julie Bannan
(74) *Attorney, Agent, or Firm* — Abelman, Frayne & Schwab

(57) ABSTRACT

Provided is a vehicular headlamp which is capable of enhancing visibility while suppressing glare by forming a dark portion in a portion of a light distribution pattern and suppressing the vicinity of the formed dark portion from becoming a blue series color. The vehicular headlamp includes a light-emitting element, a projection lens, a reflector, a beam shaper, a first shaper disposed between the light-emitting element and a cut-off line forming portion and configured to shield a part of the light reflected from the reflector to form a dark portion in a portion of a low beam light distribution pattern, and a second shaper portion disposed between the cut-off line forming portion and the projection lens and configured to shield a part of the light incident to the lower side of an optical axis of the projection lens.

8 Claims, 10 Drawing Sheets

VEHICULAR HEADLAMP

CROSS-REFERENCE TO RELATED APPLICATIONS

This application is based on and claims priority from Japanese Patent Application Nos. 2012-143334 and 2013-060960 filed on Jun. 26, 2012 and Mar. 22, 2013, respectively, with the Japan Patent Office and the disclosures of which are incorporated herein in their entireties by reference.

TECHNICAL FIELD

The present disclosure relates to a vehicular headlamp including a light source and a projection lens.

BACKGROUND

In order to suppress the glare from the opposing traffic lane, it is known that a vehicular headlamp is configured such that, for example, a shielding portion is formed in a protrusion shape on a reflective surface of a beam shaper on which a light source and a reflector are installed so as to form a dark portion in a portion of a light distribution pattern. The vehicular lamp may be further configured such that the light that forms a lower vicinity region of a cut-off line of the opposing traffic lane side in a low beam light distribution pattern does not illuminate toward the front side of the vehicle (See, e.g., Japanese Patent Laid-Open Publication No. 2008-243433).

SUMMARY

A light-emitting element such as, for example, a light emitting diode recently used as a light source has a plurality of peak wavelengths. Thus, a spectrum phenomenon by chromatic aberration inevitably occurs when light from the light-emitting element is reflected by a reflector and then penetrates a projection lens. Thus, in a vehicular headlamp such as, for example, the vehicular headlamp disclosed in Japanese Patent Laid-Open Publication No. 2008-243433, a blue series spectral color may appear in the vicinity of a dark portion formed in a low beam light distribution pattern, thereby resulting in deterioration of visibility.

An aspect of the present disclosure is to provide a vehicular headlamp in which a dark portion is formed in a part of a light distribution pattern to suppress glare and a blue series color is suppressed from being formed in the vicinity of the formed dark portion, thereby enhancing visibility.

A vehicular headlamp according to the aspect of present disclosure includes: a light source; a projection lens having an optical axis in a longitudinal direction of the vehicle; a reflector configured to reflect light generated from the light source to the vicinity of the optical axis toward a front side of the vehicle; a beam shaper including a cut-off line forming part provided in the vicinity of a rear focus of the projection lens and configured to form a cut-off line of a light distribution pattern which is reflected from the reflector and projected through the projection lens; a first shaper portion disposed between the light source and the cut-off line forming portion and configured to shield a portion of the light reflected from the reflector to form a dark portion in a portion of the light distribution pattern; and a second shaper portion disposed between the cut-off line forming portion and the projection lens and configured to shield a portion of the light incident to the lower side of the optical axis of the projection lens.

Also, the vehicular headlamp of the present disclosure further includes a light path conversion portion disposed between the first shaper portion and the second shaper portion along the longitudinal direction of the vehicle. The light path conversion portion exists at a location in the vicinity of and above the rear focus of the projection lens to reflects a part of light reflected by the reflector toward the projection lens to avoid a glare point so that the light may not cause glare to a driver of an oncoming vehicle by passing through the location and then being projected by the projection lens.

The first shaper portion of the vehicular headlamp of the present disclosure may be provided with a reflective surface configured to reflect a portion of the light reflected from the reflector toward the vicinity of the optical axis of the projection lens.

The first shaper portion and the second shaper portion of the vehicular headlamp of the present disclosure may be integrally formed at the beam shaper.

According to the vehicular headlamp of the present disclosure, incident light generating light of a blue series color which appears intensely in the vicinity of the cut-off line under the optical axis may be reduced by providing the second shaper portion shielding a portion of the light incident to the lower part of the projection lens. Therefore, a problem that the vicinity of the dark portion to suppress the glare of the cut-off line formed by the first shaper portion becomes a blue series color may be avoided, thereby enhancing the visibility. That is, the dark portion is formed to suppress glare and the vicinity of the formed dark portion is suppressed from becoming the blue series color, thereby enhancing visibility.

The above-described summary is illustration purposes only and does not intend to limit in any ways. In addition to the illustrative embodiment, examples, and features described above, additional embodiment, example, and features will become apparent by referring to the drawings and the following detailed description.

BRIEF DESCRIPTION OF THE DRAWINGS

FIGS. 4A and 4B are views illustrating light distribution patterns formed by the vehicular headlamp according to the first exemplary embodiment of the present disclosure, in which FIG. 4A is a schematic view of light distribution patterns by respective incident light and FIG. 4B is a schematic view of a low beam light distribution pattern.

FIG. 6A is a schematic view of light distribution patterns by respective incident light and FIG. 6B is a schematic view of a low beam light distribution pattern.

DETAILED DESCRIPTION

Figure 1:
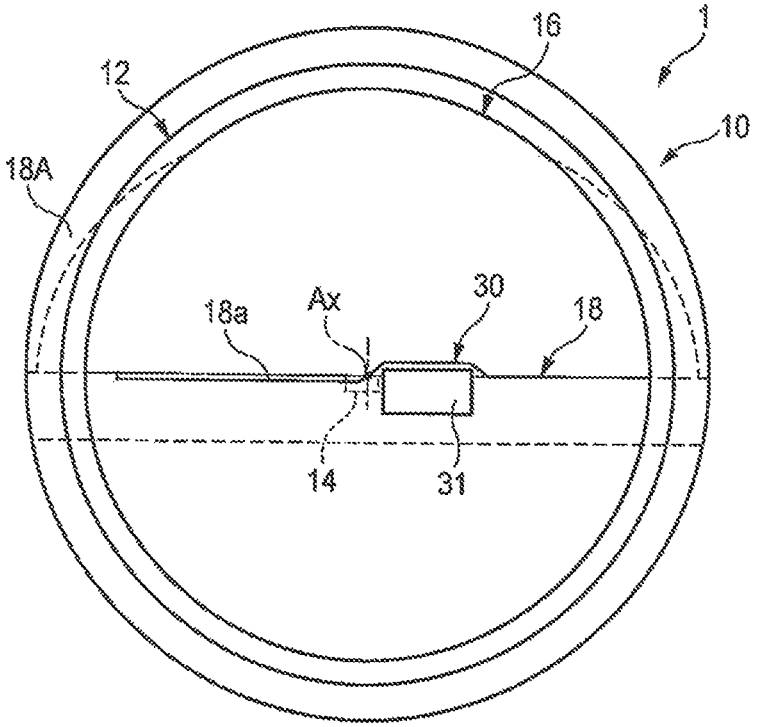
FIG. 1 is a front view illustrating a vehicular headlamp according to a first exemplary embodiment of the present disclosure.

In the following detailed description, reference is made to the accompanying drawings which form a part hereof. The illustrative embodiments described in the detailed descriptions, drawings, and claims do not intend to limit. Other embodiments may be utilized and other modified examples may be made without departing from the spirit or scope of the subject matter presented here.

Hereafter, detailed descriptions will be made for exemplary embodiments of a vehicular headlamp according to the present disclosure referring to the drawings.

First Exemplary Embodiment

Figure 2:
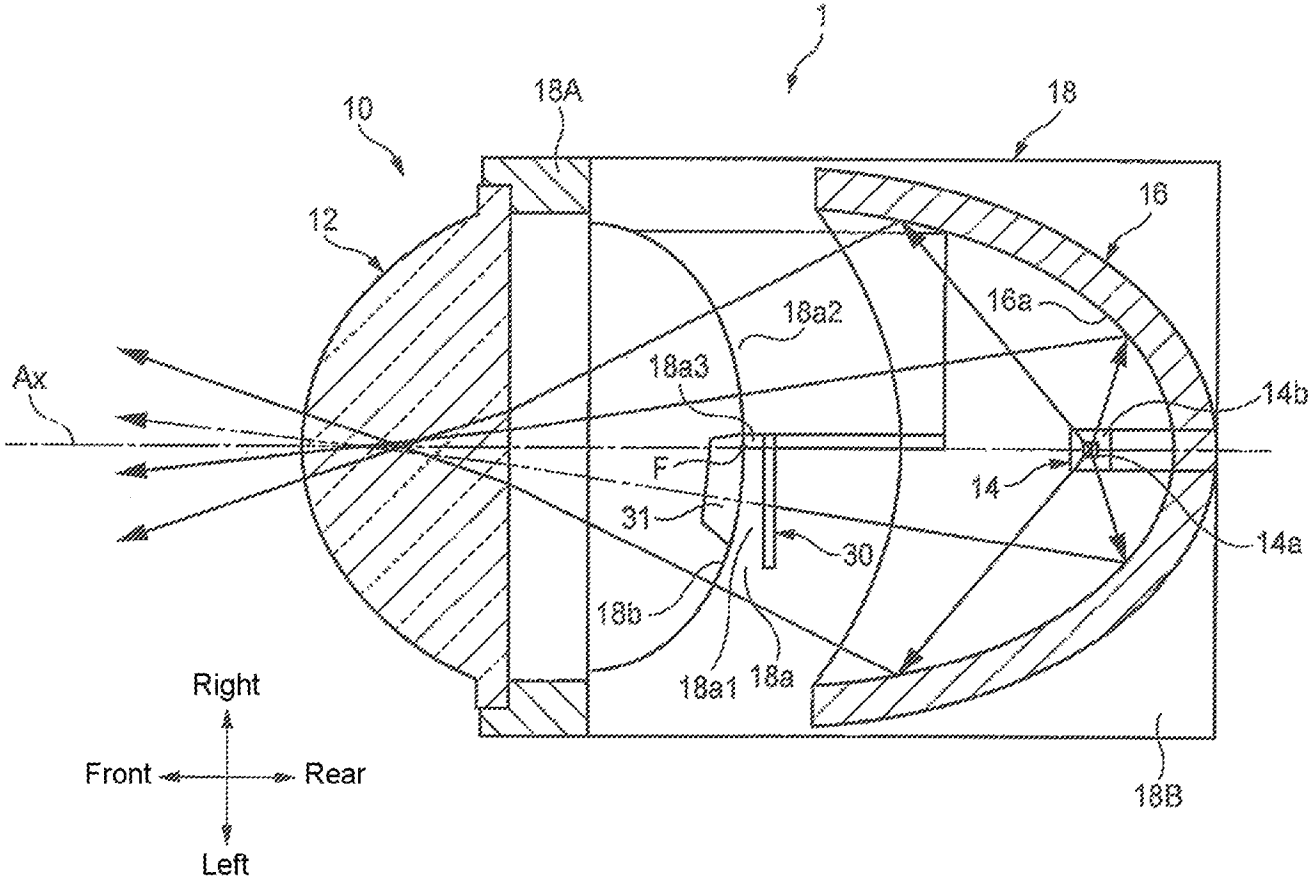
FIG. 2 is a view illustrating a horizontal cross-sectional view according to the first exemplary embodiment of the present disclosure.
Figure 3:
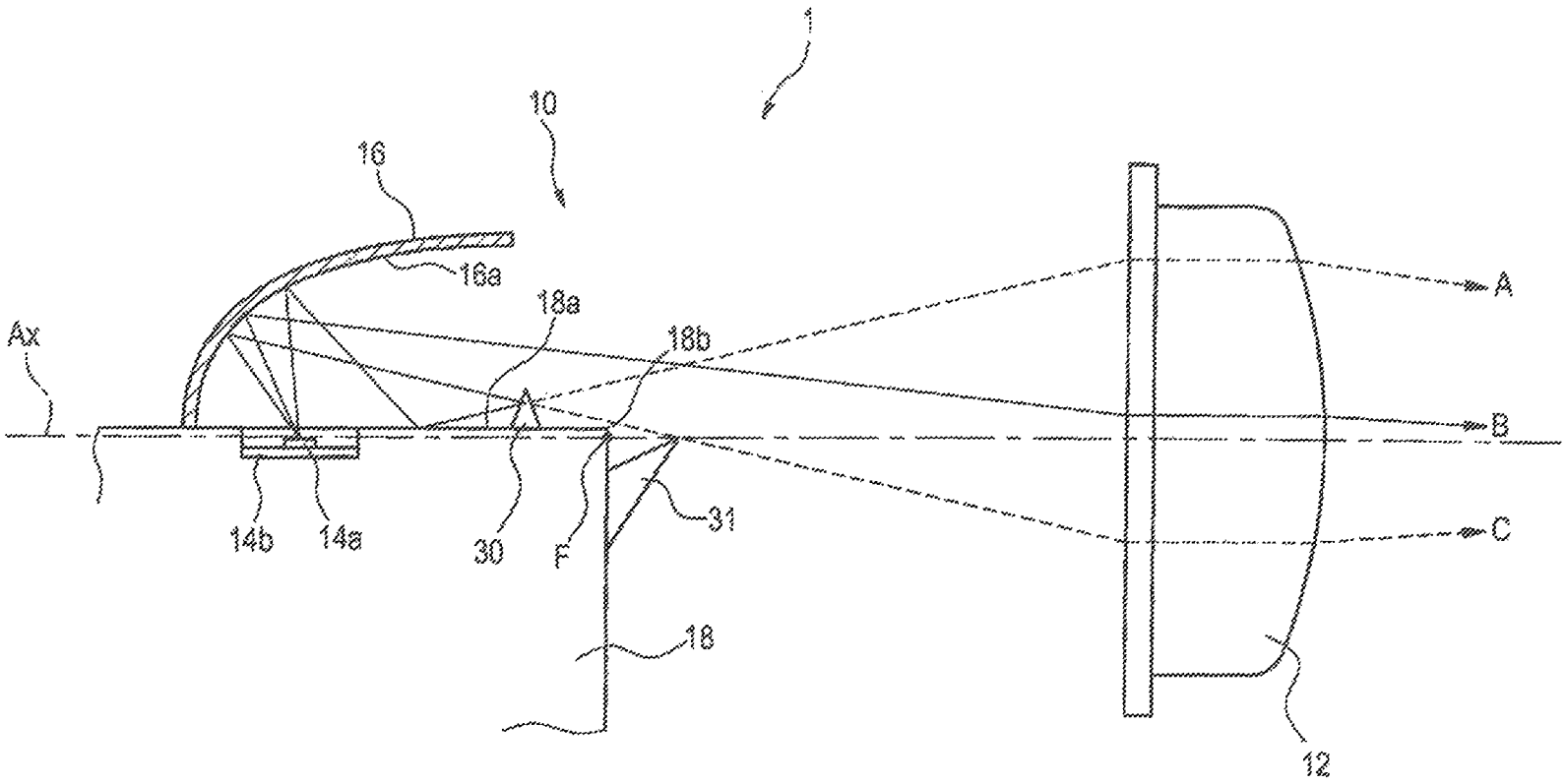
FIG. 3 is a view illustrating a schematic vertical cross-sectional view according to the first exemplary embodiment of the present disclosure.

Referring to FIGS. 1 to 3, a vehicular headlamp 1 of the present embodiment is provided with a lamp unit 10. The lamp unit 10 includes a projection lens 12, a light-emitting element (light source) 14, a reflector 16, and a beam shaper 18. Also, in the present exemplary embodiment, the front refers to a projection lens 12 side of the lamp unit 10 (the left direction of FIG. 2) and the rear refers to a reflector 16 side of the lamp unit 10 (the right direction of FIG. 2).

The lamp unit 10 is configured to be used in a state of being inserted as a part of the vehicular headlamp 1. And, the vehicular headlamp 1 is configured to illuminate the light in order to form a low beam light distribution pattern PL of the left side light distribution to the front.

The projection lens 12 is a flat-convex aspherical lens of which the front side surface is convex and the rear side surface is flat, and has an optical axis Ax extending in the longitudinal direction of the vehicle. The projection lens 12 is configured to project a light source image formed on a rear focal plane thereof (i.e., a focal plane which includes a rear focus F in this exemplary embodiment) as an inverted image on a virtual vertical screen in the front side of the lamp. The projection lens 12 is disposed in the front side of the beam shaper 18 and fixed to a ring-shaped lens holder 18A which is formed integrally with the beam shaper 18.

The light-emitting element 14 is a white light-emitting diode and disposed closer to the rear side than the rear focus F of the projection lens 12. The light-emitting element 14 includes a light-emitting chip 14*a* having a square-shaped light-emitting surface each side of which is about 1 mm and a substrate supporting the light-emitting chip 14*a*. The light-emitting chip 14*a* is sealed by a thin film formed so as to cover the light-emitting surface. And, the light-emitting chip 14*a* of the light-emitting element 14 is disposed while facing the upward direction perpendicular to the optical axis Ax and is positioned at and fixed to a concave portion formed on the top surface of a rear extension portion 18B that extends rearwards from the beam shaper 18.

The reflector 16 is disposed so as to cover the light-emitting element 14 from the upward side and reflects the light from the light-emitting element 14 to the vicinity of the optical axis Ax toward the front side. A reflective surface 16*a* of the reflector 16 is formed to have free-curved surface on a roughly ellipsoidal-surface-shape, which not only has a major axis which is the same axis as the optical axis Ax but also takes a light-emitting center of the light-emitting element 14 as a first focus. The lower end portion of a peripheral edge of the reflective surface 16*a* of the reflector 16 is fixed on the top surface of the rear extension portion 18B of the beam shaper 18.

The beam shaper 18 not only reflects a portion of the reflective light from the reflector 16 to the upward side but also forms a low beam light distribution pattern PL. The top surface of the beam shaper 18 is formed as an upward reflective surface 18*a* extending rearwards along the optical axis Ax from the location of the rear focus F. And, the beam shaper 18 is configured to reflect a portion of the reflective light to the upward side at the upward reflective surface 18*a*. The upward reflective surface 18*a* is formed by performing a mirror finish such as, for example, aluminum deposition on the top surface of the beam shaper 18.

The front end edge of the upward reflective surface 18*a* is formed as a cut-off line forming portion 18*b* and formed to extend along the rear focal plane of the projection lens 12. That is, the cut-off line forming portion 18*b* formed with the front end edge is formed to be curved such that it extends from the rear focus F toward both left and right sides of the optical axis and gradually to the front side when it is seen in a plan view. And, the cut-off line forming portion 18*b* forms a cut-off line CL of the low beam light distribution pattern PL which is reflected from the reflector 16 and projected through the projection lens 12.

In addition, the upward reflective surface 18*a* has a left region which is positioned in the left side as compared to the optical axis Ax, that is, in the traffic lane side of the vehicle (in the right side when viewed from the front side of the lamp) and formed by a first horizontal surface 18*a*1. The upward reflective surface 18*a* also a right region positioned in the right side as compared to the optical axis Ax, that is, in the opposite traffic lane side and formed by a second horizontal surface 18*a*2 which is lower than the first horizontal surface 18*a*1 in which an intermediate inclined surface 18*a*3 extending downward obliquely from the optical axis is interposed between the first horizontal surface 18*a*1 and the second horizontal surface 18*a*2. However, the right end portion sufficiently spaced apart from the rear focus F in the right side region and the rear extension portion 18B are formed to be coplanar with the first horizontal surface 18*a*1 that forms the left side region.

As illustrated in FIG. 3, the light projected from the light-emitting element 14 is reflected to the vicinity of the optical axis Ax toward the front by the reflective surface 16*a* of the reflector 16. A portion of the light is incident on the upward reflective surface 18*a* of the beam shaper 18 and then reflected from the upward reflective surface 18*a* to become incident light A to an upper region of the projection lens 12. In addition, a portion of the light reflected from the reflective surface 16*a* of the reflector 16 either forms incident light B to the vicinity of the center of the projection lens 12 or forms incident light C to a lower region of the projection lens 12. And, the incident lights A, B, C incident on the projection lens 12 are all projected to the front from the projection lens 12.

Further, a first shaper portion 30 formed by a vertical wall extending in the widthwise direction of the vehicle width direction is formed on the first horizontal surface 18*a*1 of the upward reflective surface 18*a* of the beam shaper 18 at a location spaced apart rearward from the cut-off line forming portion of the upward reflective surface 18*a*. The first shaper portion 30 serves as a shielding protrusion which shields a portion of the reflective light from the reflector 16.

Since the first shaper portion 30 is formed, the light incident on the rear surface of the first shaper portion 30 from the reflector 16 is shielded. Also, the first shaper portion 30 is configured to shield, in the light incident on the first horizontal surface 18*a*1 from the reflector 16, the light incident on the first horizontal surface 18*a*1 in the vicinity of the rear side of the first shaper portion 30 and reflected upwards, at the rear surface of the first shaper portion 30.

The light shielded by the first shaper portion 30 is the light that may pass through the rear focal plane of the projection lens 12 in the vicinity of the upper side of the cut-off line forming portion 18*b* when it is assumed that the first shaper portion 30 is not formed. Thus, the light illuminated in the vicinity of the cut-off line CL in the opposite traffic lane side is reduced due to the existence of the first shaper portion 30, thereby suppressing glare to a driver of a vehicle running on the opposite traffic lane.

Figure 4A:
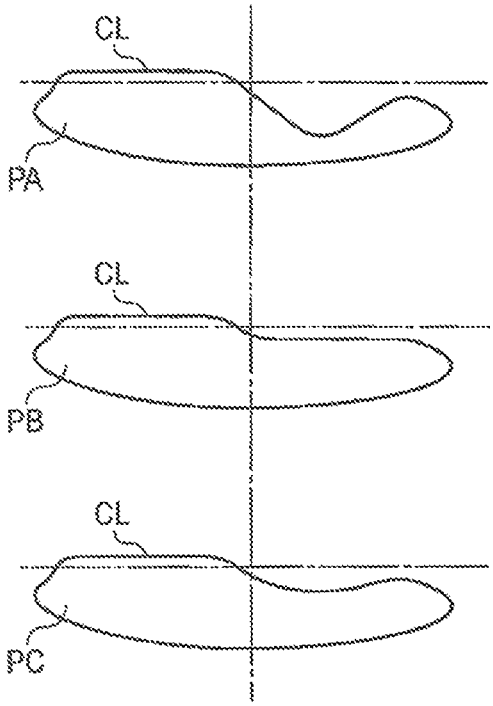

Accordingly, as illustrated in FIG. 4A, the light distribution patterns PA and PC formed from the incident lights A and C, respectively, by the first shaper portion 30 are in a state where the light illuminated to the opposite traffic lane side of the cut-off line is reduced. Also, since the light distribution pattern PB formed from the incident light B is not shielded by the first shaper portion 30, the light is not reduced in the vicinity of the cut-off line CL in the opposing traffic lane side.

Figure 4B:
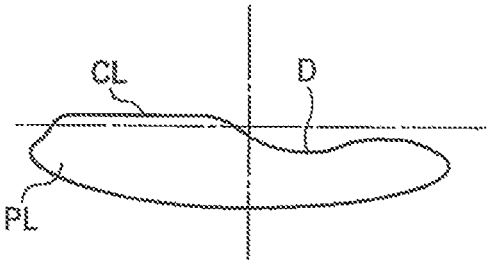

Therefore, the low beam light distribution pattern PL formed by the incident light A, B, and C is formed with a dark portion D where the illuminated light is reduced by the first shaper portion 30 in the vicinity of the cut-off line CL in the opposite traffic lane side, as illustrated in FIG. 4B, thereby facilitating the suppression of glare.

Further, the beam shaper 18 is formed with a second shaper portion 31 which is integrally formed at the front end side wall of the beam shaper 18. The second shaper portion 31 has a width slightly narrower than that of the first shaper portion 30, and protrudes forward and obliquely upward. The second shaper portion 31 is disposed between the cut-off line forming portion 18*b* of the beam shaper 18 and the projection lens 12 and serves as a shielding protrusion which shields a part of the incident light incident on the lower side of the optical axis Ax of the projection lens 12. Since the second shaper portion 31 is formed, the light incident on the rear surface of the second shaper portion 31 from the reflector 16 is shielded.

The light shielded by the second shaper portion 31 is a part of the incident light C that may be guided in the vicinity of the cut-off line CL of the low beam light distribution pattern PL when it is assumed that the second shaper portion 31 is not formed.

Figure 5:
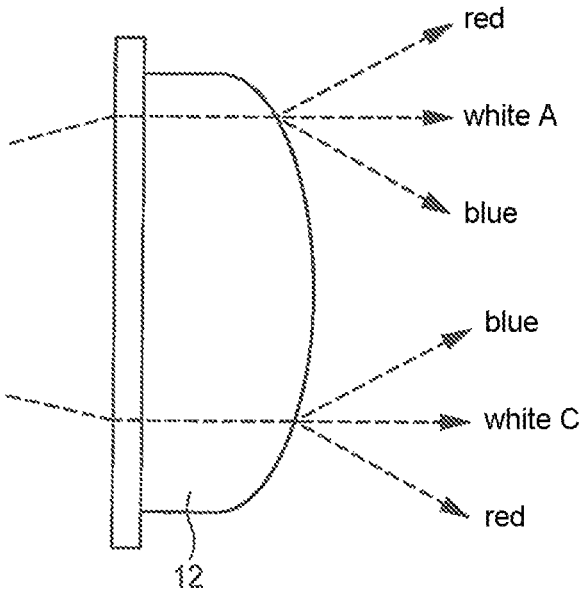
FIG. 5 is a side view of a projection lens illustrating chromatic aberration of the light that penetrates the projection lens.

The light projected from the projection lens 12 to the front of a vehicle is gradually and spectrally divided into red, white, and blue from the center of the projection lens 12 toward the outer peripheral side by chromatic aberration when penetrating the projection lens 12. The upper side and the lower side of spectral distribution are inverted with reference to the optical axis Ax of the projection lens 12. Specifically, as illustrated in FIG. 5, the spectral distribution becomes red, white, blue sequentially from the top at the upper side of the projection lens 12, and becomes blue, white, red sequentially from the top at the lower side of the projection lens 12.

Figure 6A:
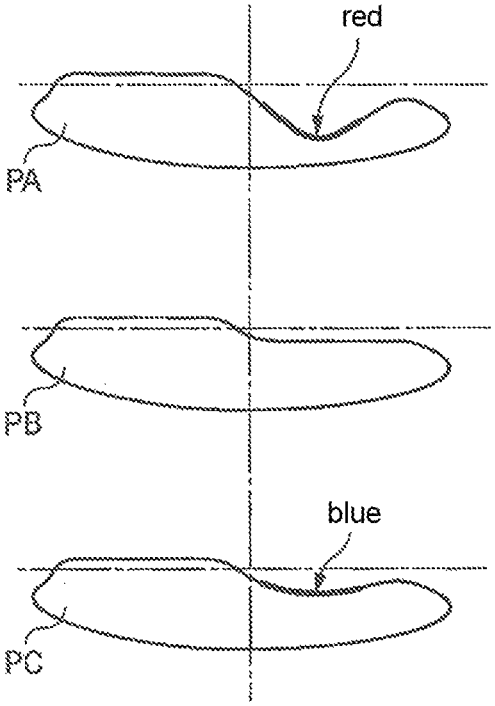
FIGS. 6A and 6B are views of light distribution patterns formed by a vehicular headlamp that does not have a second shaper part.

Thus, as illustrated in FIG. 6A, the light distribution pattern PA formed by the incident light A becomes a red series color in the vicinity of the cut-off line CL of the opposite traffic lane side. Also, when it is assumed that the second shaper portion 31 is not formed, the light distribution pattern PC formed by the incident light C becomes a blue series color in the vicinity of the cut-off line CL in the opposite traffic lane side.

However, as the incident light A penetrates the upper side of the projection lens 12, a deeply caved dark portion is formed downwardly in the cut-off line (CL) of the opposing traffic lane in the light distribution pattern PA due to the shielding by the first shaper portion 30. Thus, even if the dark portion of the light distribution pattern PA becomes a red series color, the red series color is not noticeable since it overlaps with the light distribution pattern PB formed by the incident light B.

In contrast, the light distribution pattern PC which is inverted by the projection lens 12 as the incident light C penetrates the lower side of the projection lens 12 is formed with a dark portion which is slightly caved downward in the cut-off line CL in the opposite traffic lane side due to the shielding by the first shaper portion 30. Thus, if the dark portion of the light distribution pattern PC becomes a blue series color, the light of the blue series color appears intensively in the vicinity of the cut-off line CL and becomes noticeable even if the light distribution pattern PB formed by the incident light B.

Figure 6B:
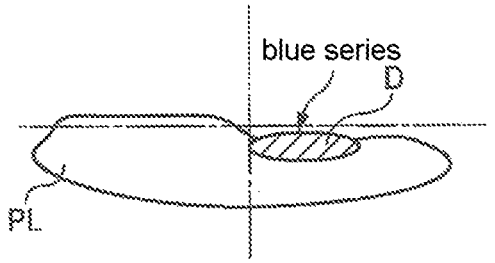

Therefore, as illustrated in FIG. 6B, the vicinity of the dark portion D formed in the low beam light distribution pattern PL by the first shaper portion 30 becomes a blue series color by the light of the blue series color guided in the vicinity of the cut-off line of the low beam light distribution pattern PL in the opposite traffic lane side. As a result, the visibility may be degraded.

However, according to the vehicular headlamp 1 of the present exemplary embodiment, the second shaper portion 31 that shields a portion of the incident light C incident on the lower portion of the projection lens 12 is provided between the cut-off line forming portion 18*b* at the location of the rear focus F of the projection lens 12 at the front end of the beam shaper 18 and the projection lens 12. By providing the second shaper portion 31, the incident light C generating the light of the blue series color which appears intensely in the vicinity of the cut-off line CL of the opposite traffic lane side at the lower side of the optical axis Ax may be reduced. Thus, the vicinity of the dark portion D formed by the first shaper portion 30 to suppress the glare of the cut-off line CL in the opposite traffic lane side becomes the blue series color, and as a result, the problem of deteriorating the visibility may be avoided.

That is, the visibility may be enhanced by suppressing the glare by forming the dark portion D in a portion of the low beam light distribution pattern PL and suppressing the vicinity of the formed dark portion D from becoming a blue series color. Also, the second shaper portion 31 is integrally formed at the beam shaper 18. Therefore, in comparison to a case in which the second shaper portion 31 is separately formed and provided, reduction in the number of components and enhancement of assembly workability may be facilitated, thereby suppressing the increase of manufacturing costs. Also, the second shaper portion 31 may surely shield the light incident on the lower portion of the projection lens 12, especially the light incident on the region close to the peripheral edge of the projection lens 12 (e.g., a region where the spectrum appears remarkably).

Figure 7:
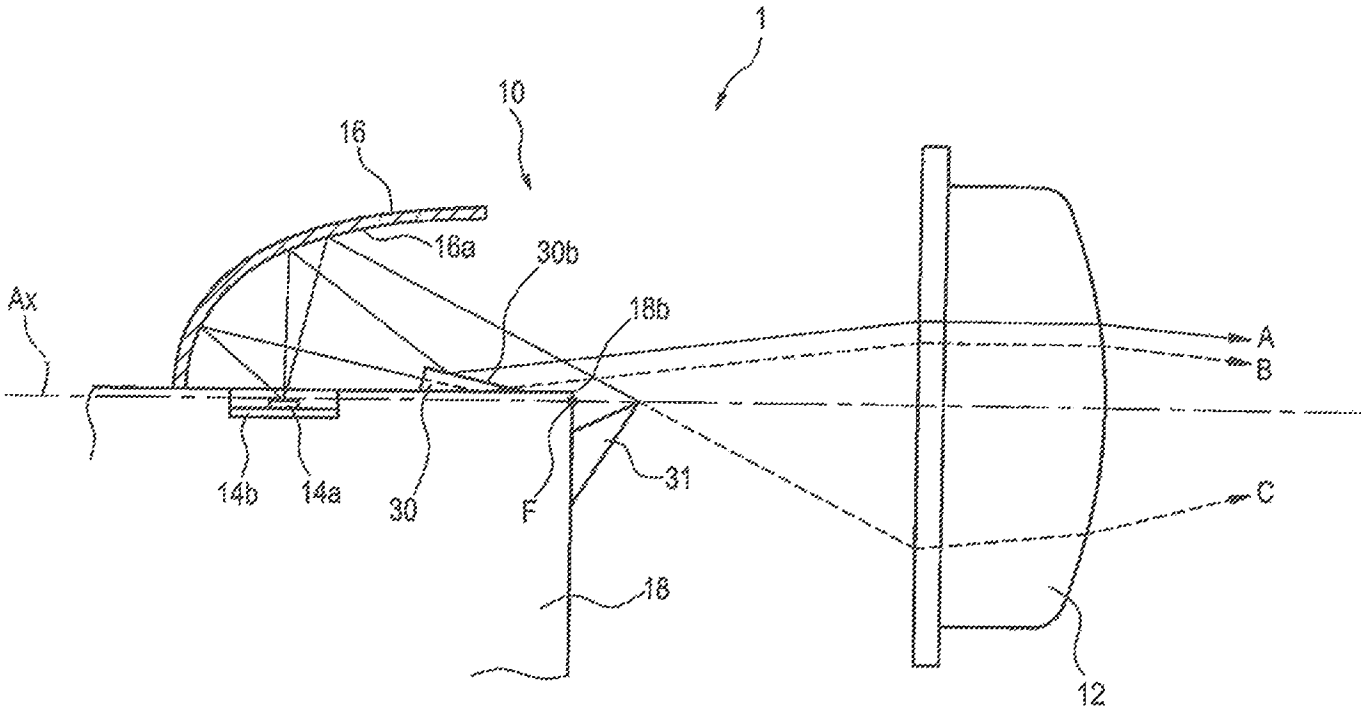
FIG. 7 is a schematic vertical cross-sectional view illustrating a vehicular headlamp according to a modified example of the first exemplary embodiment of the present disclosure.

Next, descriptions will be made about a vehicular headlamp according to a modified example of the first exemplary embodiment. Also, the same components as those of the first exemplary embodiment are assigned with the same symbols and the descriptions thereof will be omitted. FIG. 7 is a schematic vertical cross-sectional view of the vehicular headlamp according to the modified example.

As illustrated in FIG. 7, the vehicular headlamp 1 according to the modified example is formed with a reflective surface 30*b* at the front side of the first shaper portion 30 and the reflective surface 30*b* is an inclined surface gradually inclined downwardly toward the front side. The reflective surface 30*b* reflects the light shielded by the first shaper portion 30 illustrated in FIG. 3 as a portion of the reflective light from the reflector 16 (light incident on the first horizontal surface 18*a*1 in the rear vicinity of the first shaper 30 and reflected upward) toward the vicinity of the optical axis Ax of the projection lens 12.

Also, the reflective light from the reflective surface 30*b* passes the vicinity of the optical axis Ax of the projection lens 12 and is guided to the front side of the vehicle. The reflective light almost has no spectrum and forms a light distribution pattern B illustrated in FIG. 4. Accordingly, a light component of a blue series color appearing in the vicinity of the dark portion D formed in the cut-off line CL in the opposite traffic lane side at the lower side of the optical axis Ax may be made unnoticeable, thereby further enhancing the visibility.

Second Exemplary Embodiment

Figure 8:
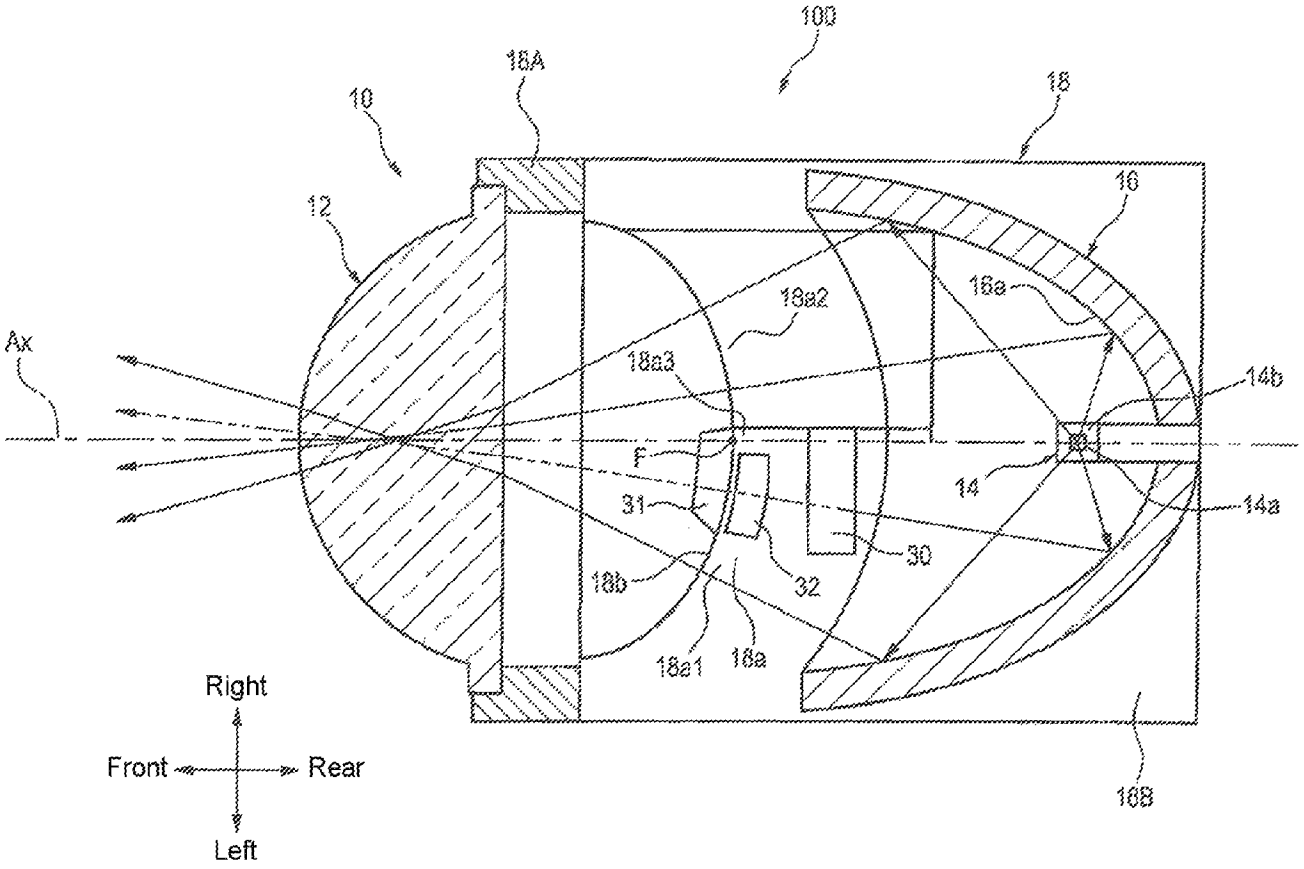
FIG. 8 is a view illustrating a horizontal cross-sectional view according to a second exemplary embodiment of the present disclosure.
Figure 9:
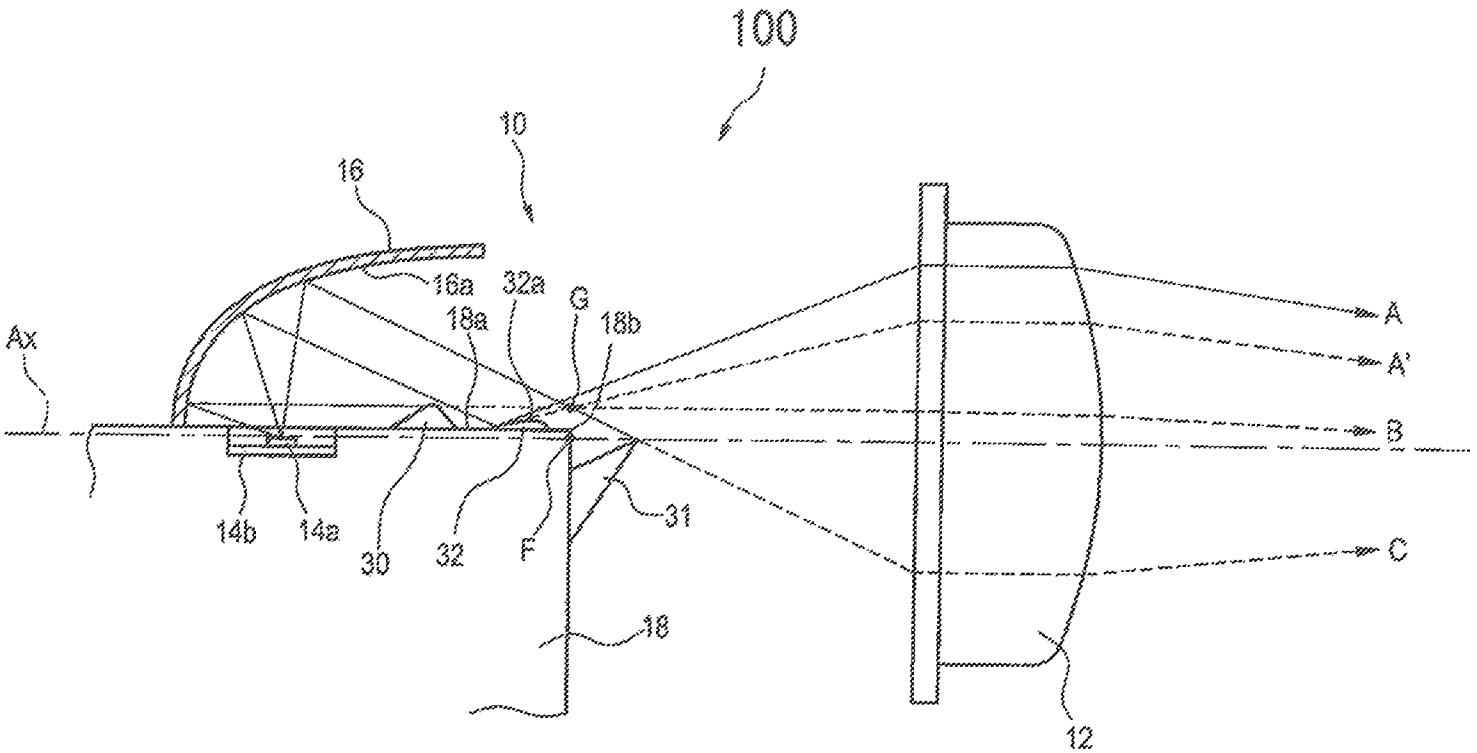
FIG. 9 is a view illustrating a schematic vertical cross-sectional view according to the second exemplary embodiment of the present disclosure.

FIG. 8 is a horizontal cross-sectional view of a vehicular headlamp 100 according to a second exemplary embodiment of the present disclosure. FIG. 9 is a schematic vertical cross-sectional view of the vehicular headlamp 100 according to the second exemplary embodiment. Also, components which are the same as or corresponding to those of the vehicular headlamp 1 are assigned with the same symbols and overlapping descriptions thereof are condignly omitted.

As illustrated FIGS. 8 and 9, the vehicular headlamp 100 is different from the vehicular headlamp 1 illustrated in, e.g., FIG. 1 in that a light path conversion portion 32 is provided.

The light path conversion portion 32 is disposed between the first shaper portion 30 and the second shaper portion 31 in the longitudinal direction of the vehicle. Also, the light path conversion portion 32 is formed between the cut-off line forming portion 18*b* of the upward reflective surface 18*a* and the first shaper portion 30 on the first horizontal surface 18*a*1 of the upward reflective surface 18*a* of the beam shaper 18. The light path conversion portion 32 is formed as a curved surface curved slightly upward in a convex shape and has an inclined surface 32*a* gradually inclining upward toward the front side. The inclined surface 32*a* of the light path conversion portion 32 serves are a reflective surface that reflects a portion of the reflective light from the reflector 16 toward the projection lens 12 while avoiding a glare point G.

The glare point G is a point which exists above and in the vicinity of the rear focus F of the projection lens 12. When the light passing through the glare point G is reflected to the front of the lamp by the projection lens 12, the light is illuminated to the location at the angles of 3.43° to the right side and 0.86° to the lower side on the virtual vertical screen disposed 25 m in front of the lamp. The light illuminated to the above-described location may reach the driver of an oncoming vehicle when the vehicle pitches up and down due to, for example, an influence of a road surface or may be reflected from the road surface in a case where the road surface is wet due to an influence of the weather such as, for example, rain and reach the driver of the oncoming vehicle. In view of suppressing the glare toward the driver of the oncoming vehicle, it is required that a dark portion (low illumination portion) be formed on the light distribution pattern.

Therefore, the inventor of the present disclosure has investigated various shapes of the shaper portions to form the dark portion on the light distribution pattern and obtained the following knowledge. That is, if the shape of the first shaper portion is designed only to form the dark portion on the light distribution pattern which has a darkness required to suppress glare, the first shaper portion 30 becomes large. In this case, not only a region of the dark portion required to suppress glare but also a peripheral region becomes dark and the area of the dark portion formed on the light distribution pattern becomes large more than necessary. Meanwhile, if the first shaper portion 30 is designed to be excessively small, the amount of light passing through the glare point G increases and the dark portion having an enough darkness to suppress glare may not be formed.

Therefore, the inventor of the present disclosure has found out that the light path conversion portion 32 is to reflect a portion of the reflective light from the reflector 16 toward the projection lens 12 while avoiding the glare point G. By providing the light path conversion portion 32, a portion of the light which is reflected toward the projection lens 12 to pass through the glare point G when the light path conversion portion 32 does not exist (for example, light A' in FIG. 9) is reflected toward the projection lens 12 so as to avoid the glare point G (light A in FIG. 9). By reflecting the light as described above, the light guided to the dark portion when the light path conversion portion 32 does not exist may be guided to the peripheral region of the dark portion while securing the darkness of the region of the dark portion sufficient for suppressing the glare. As a result, the dark portion may not become large more than necessary.

Figure 10:
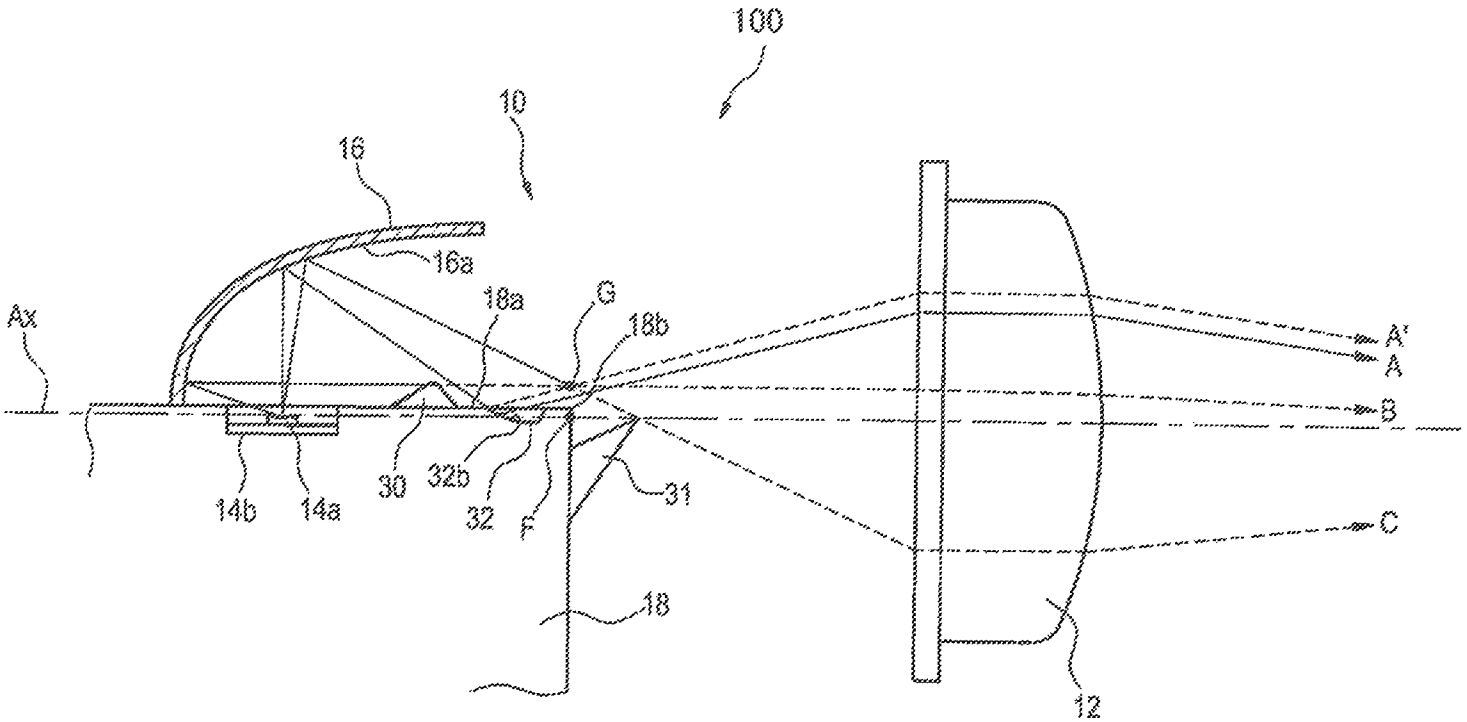
FIG. 10 is a schematic vertical cross-sectional view illustrating a vehicular headlamp according to a modified example of the second exemplary embodiment of the present disclosure.

Next, descriptions will be made about a vehicular headlamp according to a modified example of the second exemplary embodiment. Also, the same components as those of the second exemplary embodiment are assigned with the same symbols and the descriptions thereof will be omitted. FIG. 10 is a schematic vertical cross-sectional view of the vehicular headlamp 100 according to the modified example.

The light path conversion portion 32 of vehicular headlamp 100 according to the modified example is formed as a curved surface curved slightly downward in a concave shape and has an inclined surface 32*b* gradually inclined downwardly toward the front side. The inclined surface 32*b* of the light path conversion portion 32 serves as a reflective surface that reflects a portion of the reflective light from the reflector 16 toward the projection lens 12 while avoiding the glare point G.

By reflecting the light (light A in FIG. 10) toward the projection lens 12 while avoiding the glare point G by the inclined surface 32*b*, the light guided to the dark portion when the light path conversion portion 32 does not exist (light A' in FIG. 10) may be guided to the peripheral region of the dark portion while securing the darkness of the region of the dark portion sufficient for suppressing the glare. Therefore, the dark portion may be suppressed from becoming large more than necessary.

Descriptions have been made about the vehicular headlamp according to the first and second embodiments or the modified examples thereof. It has been difficult to adjust the darkness, the area, and the degree of chromatic aberration of the dark portion formed in a portion of the light distribution pattern by designing a single shape of the shaper portion as in the conventional method. However, the darkness, the area, and the degree of chromatic aberration of the dark portion may be adjusted by forming a plurality of portions (for example, two shaper portions 30, 31 or two shaper portions 30, 31 and the light path conversion portion 32) as in the vehicular headlamps according to the above-described first and second embodiments or the modified examples thereof.

Also, the present disclosure is not limited to each of the above-described embodiments or examples and may be condignly modified or improved. Other components of the above-described exemplary embodiments such as, for example, material, shape, dimension, form, number, and location are arbitrary and are not limited as long as the present disclosure may be achieved.

For example, the configurations of the first and second embodiments or the modified examples thereof may be properly combined in the scope of obtaining the effect by each of the configurations.

Further, the reflective surface 32*a* of the light path conversion portion 32 of the second exemplary embodiment may be an inclined surface which inclines gradually upward toward the rear side. Also, the reflective surface 32*b* of the light path conversion portion 32 according to the modified example of the second exemplary embodiment may be an inclined surface which inclines gradually downward toward the rear side. That is, the light path conversion portion 32 may be a shape having a portion which reflects a portion of the reflective light from the reflector 16 toward the projection lens 12 while avoiding the glare point G.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A vehicular headlamp for a vehicle comprising:

a light source;

a projection lens having an optical axis in a longitudinal direction of the vehicle;

a reflector configured to reflect light generated from the light source to the vicinity of the optical axis toward a front side of the vehicle;

a beam shaper including a cut-off line forming part provided in the vicinity of a rear focus of the projection lens and configured to form a cut-off line of a light distribution pattern which is reflected from the reflector and projected through the projection lens;

a first shaper portion protruded from a reflective surface of the beam shaper between the light source and the cut-off line forming portion and configured to shield a portion of the light reflected from the reflector to form a dark portion in a portion of the light distribution pattern, the reflective surface of the beam shaper being provided above the rear focus positioned on the optical axis of the projection lens; and a second shaper portion obliquely protruded upwardly from a side wall of the beam shaper toward a front side of the vehicle between the cut-off line forming portion and the projection lens and configured to shield a portion of the light incident to the lower side of the optical axis of the projection lens.

2. The vehicular headlamp according to claim 1, further comprising:

a light path conversion portion having a curved surface of a convex shape disposed on the reflective surface of the beam shaper between the first shaper portion and the second shaper portion along the longitudinal direction of the vehicle, wherein the light path conversion portion is provided with an inclined surface gradually inclining upwardly toward the front side of the vehicle at a location in the vicinity of and above the rear focus of the projection lens in order to reflect a part of light reflected by the reflector toward the curved surface of the light path conversion portion the projection lens.

3. The vehicular headlamp according to claim 1, wherein the first shaper portion is provided with a reflective surface configured to reflect a portion of the light reflected from the reflector toward the vicinity of the optical axis of the projection lens.

4. The vehicular headlamp according to claim 2, wherein the first shaper portion is provided with a reflective surface configured to reflect a portion of the light reflected from the reflector toward the vicinity of the optical axis of the projection lens.

5. The vehicular headlamp according to claim 1, wherein the first shaper portion and the second shaper portion are integrally formed at the beam shaper.

6. The vehicular headlamp according to claim 2, wherein the first shaper portion and the second shaper portion are integrally formed at the beam shaper.

7. The vehicular headlamp according to claim 3, wherein the first shaper portion and the second shaper portion are integrally formed at the beam shaper.

8. The vehicular headlamp according to claim 4, wherein the first shaper portion and the second shaper portion are integrally formed at the beam shaper.

* * * * *